US008692475B2

(12) United States Patent
Wang

(10) Patent No.: US 8,692,475 B2
(45) Date of Patent: Apr. 8, 2014

(54) PFC LED DRIVER CAPABLE OF REDUCING CURRENT RIPPLE

(75) Inventor: Yen-Hui Wang, Taipei (TW)

(73) Assignee: Immense Advance Technology Corporation, Taipei (TW)

( * ) Notice: Subject to any disclaimer, the term of this patent is extended or adjusted under 35 U.S.C. 154(b) by 50 days.

(21) Appl. No.: 13/569,749

(22) Filed: Aug. 8, 2012

(65) Prior Publication Data

US 2014/0042925 A1 Feb. 13, 2014

(51) Int. Cl.
*H05B 37/00* (2006.01)

(52) U.S. Cl.
USPC ..... 315/232; 315/122; 315/185 R

(58) Field of Classification Search
USPC ..... 315/232, 121, 122, 185 R, 312, 186, 188
See application file for complete search history.

(56) References Cited

U.S. PATENT DOCUMENTS

2006/0261754 A1* 11/2006 Lee ..... 315/291
2010/0052569 A1* 3/2010 Hoogzaad et al. ..... 315/294

* cited by examiner

*Primary Examiner* — Daniel D Chang
(74) *Attorney, Agent, or Firm* — The Weintraub Group, P.L.C.

(57) ABSTRACT

A PFC LED driver capable of reducing current ripple, comprising: a current source unit, having a control terminal coupled to a control voltage, which is a ratio of a full-wave rectified line input voltage, a first channel terminal coupled to a power line, and a second channel terminal used to generate an output current according to the control voltage; and at least one LED load unit, being in series with the current source unit, wherein each of the at least one LED load unit comprises: a first load, including a first parallel combination of an LED module and a capacitor, wherein the LED module has at least one light emitting diode; a diode, being in a first series combination with the first load; and a switch, being in a second parallel combination with the second series combination.

10 Claims, 8 Drawing Sheets

PFC LED DRIVER CAPABLE OF REDUCING CURRENT RIPPLE

BACKGROUND OF THE INVENTION

1. Field of the Invention

The present invention relates to a PFC (power factor correction) LED (light emitting diode) driver, especially to a PFC LED driver capable of reducing current ripple.

2. Description of the Related Art

For general linear LED drivers, inferior efficiencies are their major disadvantages. Common solutions for improving efficiencies are to divide a string of LEDs into several sections, and select one section or multiple sections thereof to act as a load according to the voltage of a full-wave rectified line input voltage.

FIG. 1 illustrates a circuit diagram of a prior art PFC LED driver. As illustrated in FIG. 1, the prior art PFC LED driver includes an amplifier 110, resistors 111-113, an NMOS transistor 114, LED modules 120, 130, and 140, and switches 121, 131, and 141.

The amplifier 110 has a positive input coupled to a control voltage $V_C$, a negative input coupled to the resistor 113, and an output coupled to the NMOS (n type metal oxide semiconductor) transistor 114.

The resistors 111 and 112 are used to divide a full-wave rectified line input voltage $V_{IN}$ to generate the control voltage $V_C$.

The resistor 113 is used to convert an output current $I_O$ into a voltage.

The NMOS transistor 114 is used to provide a high output impedance for the output current $I_O$.

The LED module 120 and the switch 121 form a first parallel combination, the LED module 130 and the switch 131 form a second parallel combination, the LED module 140 and the switch 141 form a third parallel combination, and the first parallel combination, the second parallel combination, and the third parallel combination are connected in series.

When in operation, the voltage at the negative input of the amplifier 110 will follow the control voltage $V_C$ due to a negative feedback mechanism of this circuit, and the output current $I_O$ will thereby follow the full-wave rectified line input voltage $V_{IN}$. Besides, switch control signals $S_1$, $S_2$, $S_3$ will switch the switches 121, 131, 141 according to the voltage of the full-wave rectified line input voltage $V_{IN}$, to select a corresponding LED module or corresponding LED modules from the LED modules 120, 130, 140 to serve as a load for the LED driver, so as to improve the power efficiency. For example, the LED module 120 can be selected as the load with the switch 121 being turned off and the switches 131, 141 being turned on when the full-wave rectified line input voltage $V_{IN}$ is under a first threshold; the LED module 120 and the LED module 130 can be selected to form the load with the switches 121, 131 being turned off and the switch 141 being turned on when the full-wave rectified line input voltage $V_{IN}$ is above the first threshold and under a second threshold; and the LED module 120, the LED module 130, and the LED module 140 can be selected to form the load with the switches 121, 131, 141 being turned off when the full-wave rectified line input voltage $V_{IN}$ is above the second threshold.

FIG. 2 illustrates a circuit diagram of another prior art PFC LED driver. As illustrated in FIG. 2, the prior art PFC LED driver includes an amplifier 210, resistors 211-213, an NMOS transistor 214, LED modules 220, 230, and 240, and switches 231, 241.

The amplifier 210 has a positive input coupled to a control voltage $V_C$, a negative input coupled to the resistor 213, and an output coupled to the NMOS transistor 214.

The resistors 211 and 212 are used to divide a full-wave rectified line input voltage $V_{IN}$ to generate the control voltage $V_C$.

The resistor 213 is used to convert an output current $I_O$ into a voltage.

The NMOS transistor 214 is used to provide a high output impedance for the output current $I_O$.

The LED module 220 and the switch 221 form a first parallel combination. The LED module 230 forms a first series combination with the first parallel combination. The switch 231 forms a second parallel combination with the first series combination. The LED module 240 forms a second series combination with the second parallel combination.

When in operation, the voltage at the negative input of the amplifier 210 will follow the control voltage $V_C$ due to a negative feedback mechanism of this circuit, and the output current $I_O$ will thereby follow the full-wave rectified line input voltage $V_{IN}$. Besides, switch control signals $S_4$, $S_5$ will switch the switches 221, 231 according to the voltage of the full-wave rectified line input voltage $V_{IN}$, to select a corresponding LED module or corresponding LED modules from the LED modules 220, 230, 240 to serve as a load for the LED driver, and thereby improve the power efficiency. For example, the LED module 240 can be selected as the load with the switches 221, 231 being turned on when the full-wave rectified line input voltage $V_{IN}$ is under a first threshold; the LED module 230 and the LED module 240 can be selected to form the load with the switches 221 being turned on and the switch 231 being turned off when the full-wave rectified line input voltage $V_{IN}$ is above the first threshold and under a second threshold; and the LED module 220, the LED module 230, and the LED module 240 can be selected to form the load with the switches 221, 231 being turned off when the full-wave rectified line input voltage $V_{IN}$ is above the second threshold.

Please refer to FIG. 3, which illustrates corresponding waveforms of the full-wave rectified line input voltage $V_{IN}$ and the output current $I_O$ of the circuits in FIG. 1 and FIG. 2. As illustrated in FIG. 3, the output current $I_O$ has an average of $I_{AVG}$ and varies proportional to the full-wave rectified line input voltage $V_{IN}$ most of the time to result in a good power factor.

However, although the electrical power efficiency is improved, the luminous efficiency—the ratio of luminous flux to electrical power—is substantially degraded due to a fact that, the LED currents in FIG. 1 and FIG. 2 are generated to have waveforms analog to the waveform of the full-wave rectified line input voltage to meet a high PFC requirement, and thereby has a large ripple. For LEDs, large current ripples are adverse to luminous efficiency and can cause a flicker phenomenon that is uncomfortable to human eyes. To have a good luminous efficiency and eliminate the flicker phenomenon, the waveform of the LED current is expected to be as close to a DC line as possible, but with the LED current close to a DC line, the power factor can be greatly compromised.

To solve the foregoing tangled problems, a novel PFC LED driver is therefore needed.

SUMMARY OF THE INVENTION

One objective of the present invention is to disclose a PFC LED driver capable of reducing the current ripple of LEDs to improve the luminous efficiency without compromising the power factor.

Another objective of the present invention is to disclose a PFC LED driver capable of reducing the current ripple of LEDs without compromising the electrical power efficiency.

Still another objective of the present invention is to disclose a PFC LED driver capable of reducing the current ripple of LEDs to prevent a flicker phenomenon.

To attain the foregoing objectives, a PFC LED driver capable of reducing current ripple is proposed, including:

a current source unit, having a control terminal, a first channel terminal, and a second channel terminal, the control terminal being coupled to a control voltage, which is a ratio of a full-wave rectified line input voltage, the first channel terminal being coupled to a power line, and the second channel terminal being used to generate an output current according to the control voltage; and at least one LED load unit, being in series with the current source unit, wherein each of the at least one LED load unit includes:

a first load, including a first parallel combination of an LED module and a capacitor, wherein the LED module has at least one light emitting diode;

a diode, being in a first series combination with the first load; and a switch, being in a second parallel combination with the first series combination.

In one embodiment, the power line is a ground.

In one embodiment, the power line is the full-wave rectified line input voltage.

In one embodiment, the PFC LED driver capable of reducing current ripple further includes a voltage divider, which is coupled between the full-wave rectified line input voltage and a ground for generating the control voltage.

In one embodiment, the voltage divider includes two resistors connected in series.

To attain the foregoing objectives, another PFC LED driver capable of reducing current ripple is proposed, including:

a current source unit, having a control terminal, a first channel terminal, and a second channel terminal, the control terminal being coupled to a control voltage, which is a ratio of a full-wave rectified line input voltage, the first channel terminal being coupled to a power line, and the second channel terminal being used to generate an output current according to the control voltage; and an LED load unit, being in series with the current source unit, wherein the LED load unit includes:

a first load, including a first parallel combination of a first LED module and a first capacitor, wherein the first LED module has at least one light emitting diode;

a first diode, being in a first series combination with the first load;

a first switch, being in a second parallel combination with the first series combination;

a second load, including a third parallel combination of a second LED module and a second capacitor, wherein the LED module has at least one light emitting diode;

a second diode, being in a second series combination with the second load and the second parallel combination; and a second switch, being in a fourth parallel combination with the second series combination.

In one embodiment, the power line is a ground.

In one embodiment, the power line is the full-wave rectified line input voltage.

In one embodiment, the PFC LED driver capable of reducing current ripple further includes a voltage divider, which is coupled between the full-wave rectified line input voltage and a ground for generating the control voltage.

In one embodiment, the voltage divider includes two resistors connected in series.

To make it easier for our examiner to understand the objective of the invention, its structure, innovative features, and performance, we use preferred embodiments together with the accompanying drawings for the detailed description of the invention.

DETAILED DESCRIPTION OF THE PREFERRED EMBODIMENTS

The present invention will be described in more detail hereinafter with reference to the accompanying drawings that show the preferred embodiments of the invention.

Figure 1:
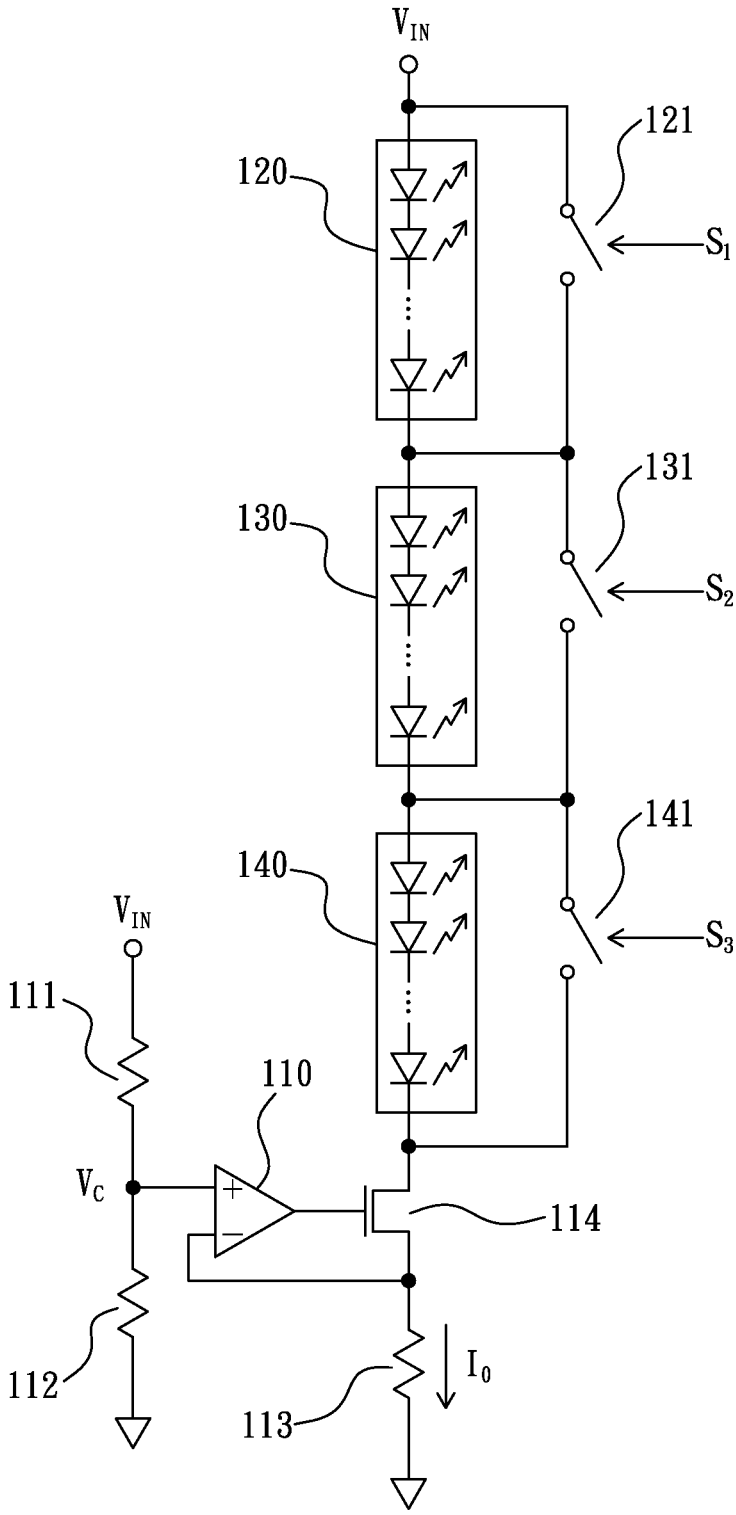
(PRIOR ART) FIG. 1
FIG. 1 illustrates a circuit diagram of a prior art PFC LED driver.
Figure 2:
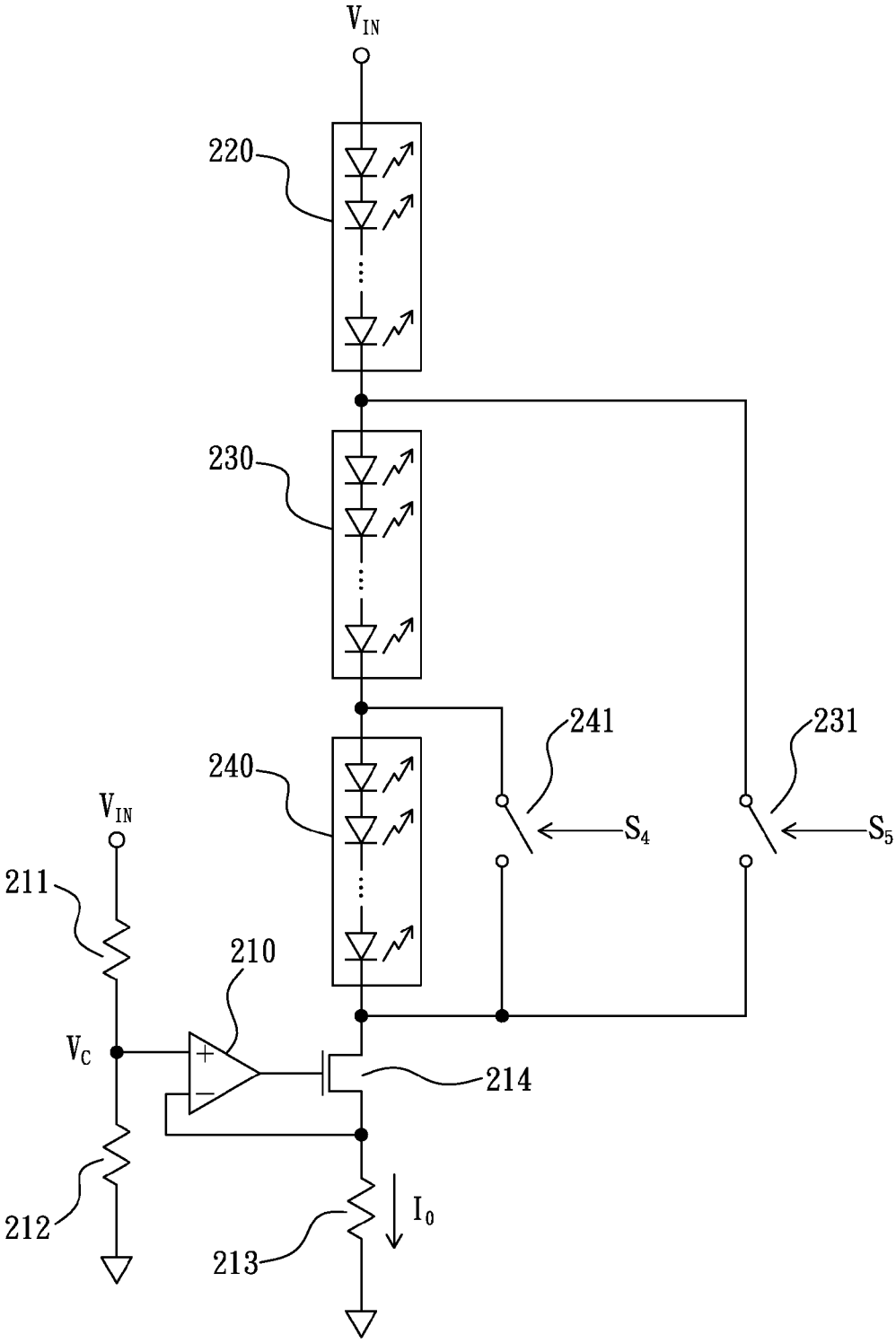
(PRIOR ART) FIG. 2
FIG. 2 illustrates a circuit diagram of another prior art PFC LED driver.
Figure 3:
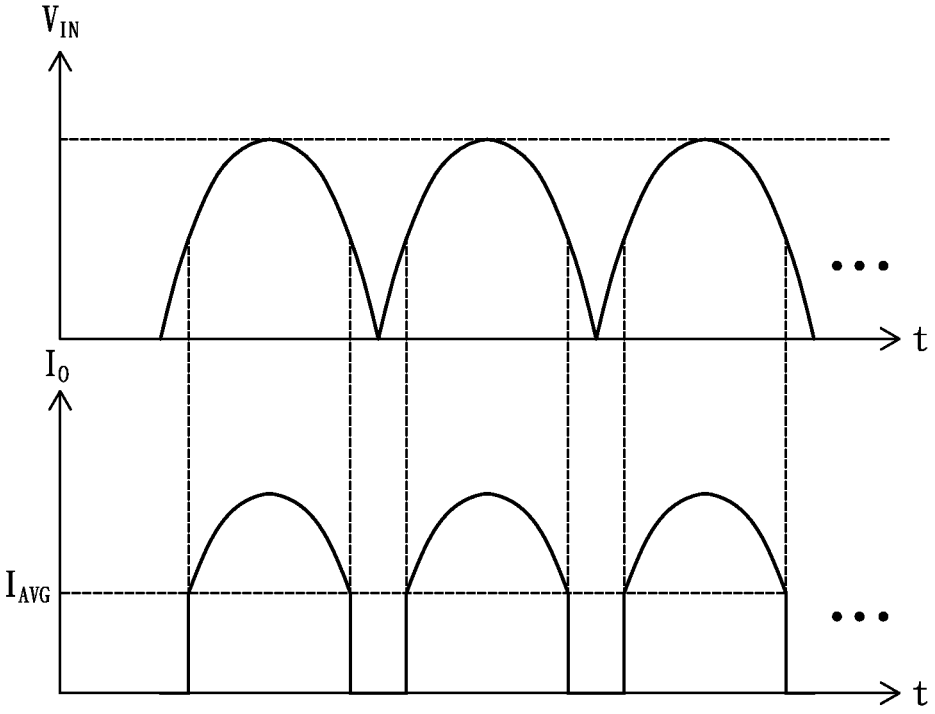
(PRIOR ART) FIG. 3
FIG. 3 illustrates corresponding waveforms of the full-wave rectified line input voltage $V_{IN}$ and the output current $I_O$ of the circuits in FIG. 1 and FIG. 2.
Figure 4:
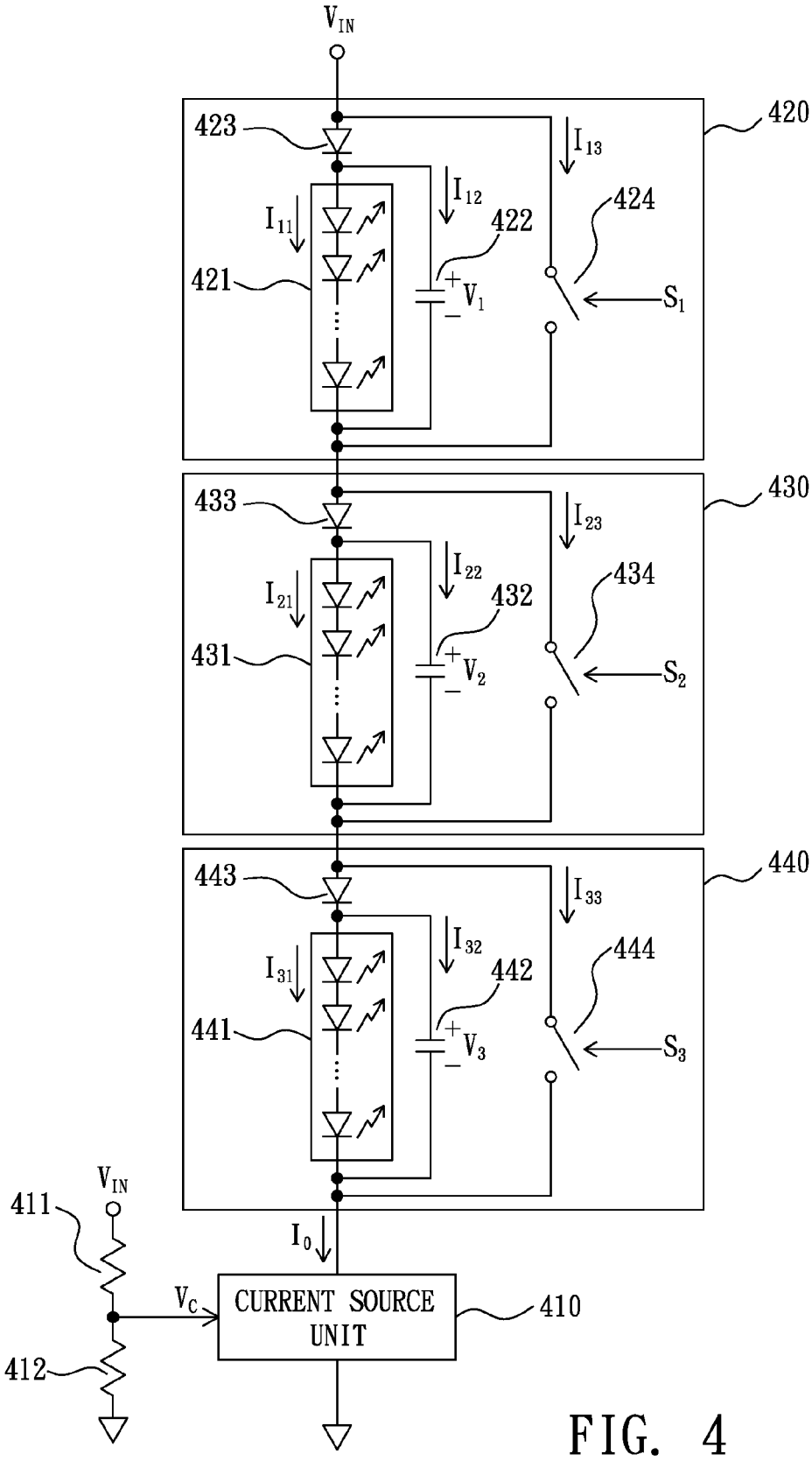
FIG. 4 illustrates a circuit diagram of a PFC LED driver capable of reducing current ripple according to a preferred embodiment of the present invention.

Please refer to FIG. 4, which illustrates a circuit diagram of a PFC LED driver capable of reducing current ripple according to a preferred embodiment of the present invention. As illustrated in FIG. 4, the PFC LED driver capable of reducing current ripple includes a current source unit 410, resistors 411-412, and LED load units 420, 430, and 440.

The current source unit 410 has a control terminal coupled to a control voltage $V_C$, a first channel terminal coupled to a ground, and a second channel terminal for generating an output current $I_O$ according to the control voltage $V_C$.

The resistors 411 and 412 are used to divide a full-wave rectified line input voltage $V_{IN}$ to generate the control voltage $V_C$.

The LED load unit 420, being in series with the current source unit 410, includes an LED module 421, a capacitor 422, a diode 423, and a switch 424.

The LED module 421 and the capacitor 422 are in a first parallel combination to form a first load, and the LED module 421 has at least one light emitting diode.

The diode 423 is in a first series combination with the first load.

The switch 424 is in a second parallel combination with the first series combination.

The LED load unit 430 is in series with the current source unit 410 and has the same circuit network as the LED load unit 420. The LED load unit 430 includes an LED module 431, a capacitor 432, a diode 433, and a switch 434.

The LED load unit 440 is in series with the current source unit 410 and has the same circuit network as the LED load unit 420. The LED load unit 440 includes an LED module 441, a capacitor 442, a diode 443, and a switch 444.

When in operation, the output current $I_O$ will follow the control voltage $V_C$, and thereby follow the full-wave rectified line input voltage $V_{IN}$. Besides, switch control signals $S_1$, $S_2$, $S_3$ will switch the switches 424, 434, 444 according to the full-wave rectified line input voltage $V_{IN}$, to select a corresponding LED module or corresponding LED modules from the LED modules 421, 431, 441 to serve as a load for the LED driver, so as to improve the power efficiency. That is, the LED module 421, for example, will be selected as the load with the switch 424 being turned off and the switches 434, 444 being turned on when the full-wave rectified line input voltage $V_{IN}$ is under a first threshold; the LED module 421 and the LED module 431, for example, will be selected to form the load with the switches 424, 434 being turned off and the switch 444 being turned on when the full-wave rectified line input voltage $V_{IN}$ is above the first threshold and under a second threshold; and the LED module 421, the LED module 431, and the LED module 441 will be selected to form the load with the switches 424, 434, 444 being turned off when the full-wave rectified line input voltage $V_{IN}$ is above the second threshold.

Figure 5A:
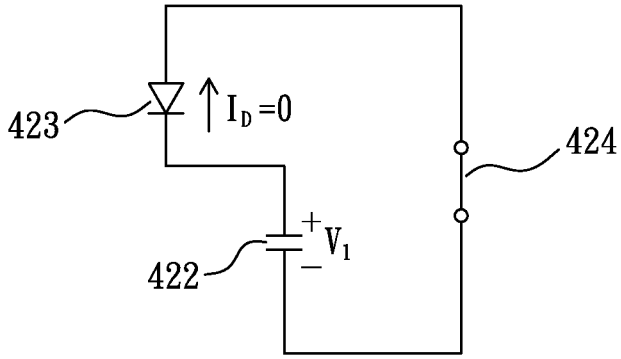
FIG. 5*a* illustrates a scenario where a switch is turned on and the charge on a capacitor is protected by a reversely biased diode from being discharged by the switch.

Besides, the diodes 423, 433, and 443 are used to protect the capacitors 422, 432, and 442 from being discharged by the switches 424, 434, and 444 to increase the power efficiency. Please refer to FIG. 5*a*, which illustrates a scenario where the switch 424 is turned on. As can be seen in FIG. 5*a*, the diode 423 is reversely biased by a voltage $V_1$ across the capacitor 422 to be off, and the charge on the capacitor 422 is therefore protected from being discharged by the switch 424.

Figure 5B:
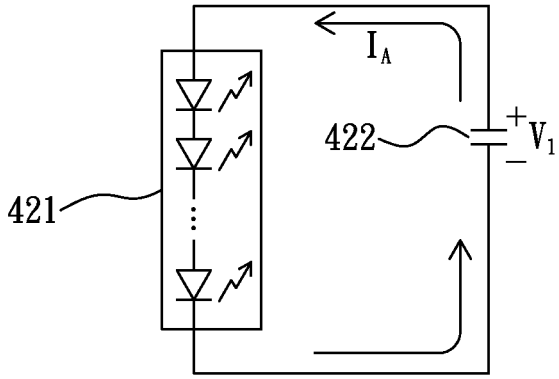
FIG. 5*b* illustrates a scenario where the capacitor of FIG. 5*a* contributes a current $I_A$ to an LED module when the diode of FIG. 5*a* is off.

Besides, the capacitors 422, 432, and 442 are used to reduce the current ripples of currents $I_{11}$, $I_{21}$, $I_{31}$ of the LED modules 421, 431, 441 to improve the luminous efficiencies of the LED modules 421, 431, 441. Please refer to FIG. 5*b*, which illustrates a scenario where the capacitor 422 contributes a current $I_A$ to the LED module 421 when the diode 423 is off. In addition, if the voltage at the anode of the diode 423 is rising up and the output current $I_O$ is increasing accordingly, the capacitor 422 can share part of the increased current. As a result, the current of the LED module 421 will be regulated by the capacitor 422 to have a much smaller ripple, and the LED module 421 will therefore have a much better luminous efficiency and a much less flicker, and in the mean time, the waveform of the output current $I_O$ will still follow that of the full-wave rectified line input voltage $V_{IN}$ to offer an excellent power factor.

Figure 6:
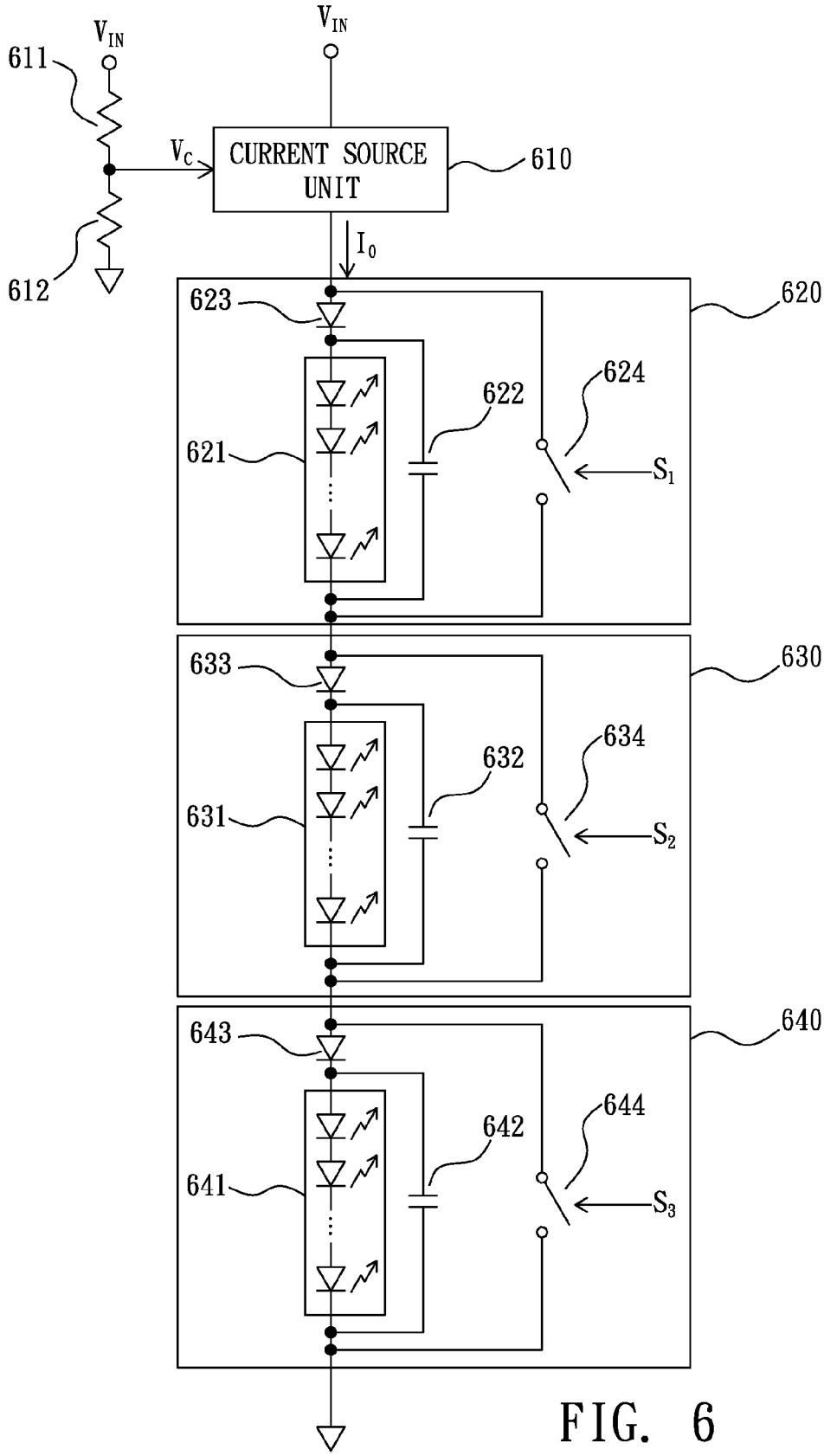
FIG. 6 illustrates a circuit diagram of a PFC LED driver capable of reducing current ripple according to another preferred embodiment of the present invention.

Although the current source unit 410 is placed at the bottom of the circuit in FIG. 4, it can also be put at the top. Please refer to FIG. 6, which illustrates a circuit diagram of a PFC LED driver capable of reducing current ripple according to another preferred embodiment of the present invention. As can be seen in FIG. 6, the PFC LED driver capable of reducing current ripple includes a current source unit 610, resistors 611-612, and LED load units 620, 630, and 640, and the current source unit 610 is at the top of the circuit. As the operation principle of the circuit in FIG. 6 is same as that of the circuit in FIG. 4, it will not be readdressed here.

Figure 7:
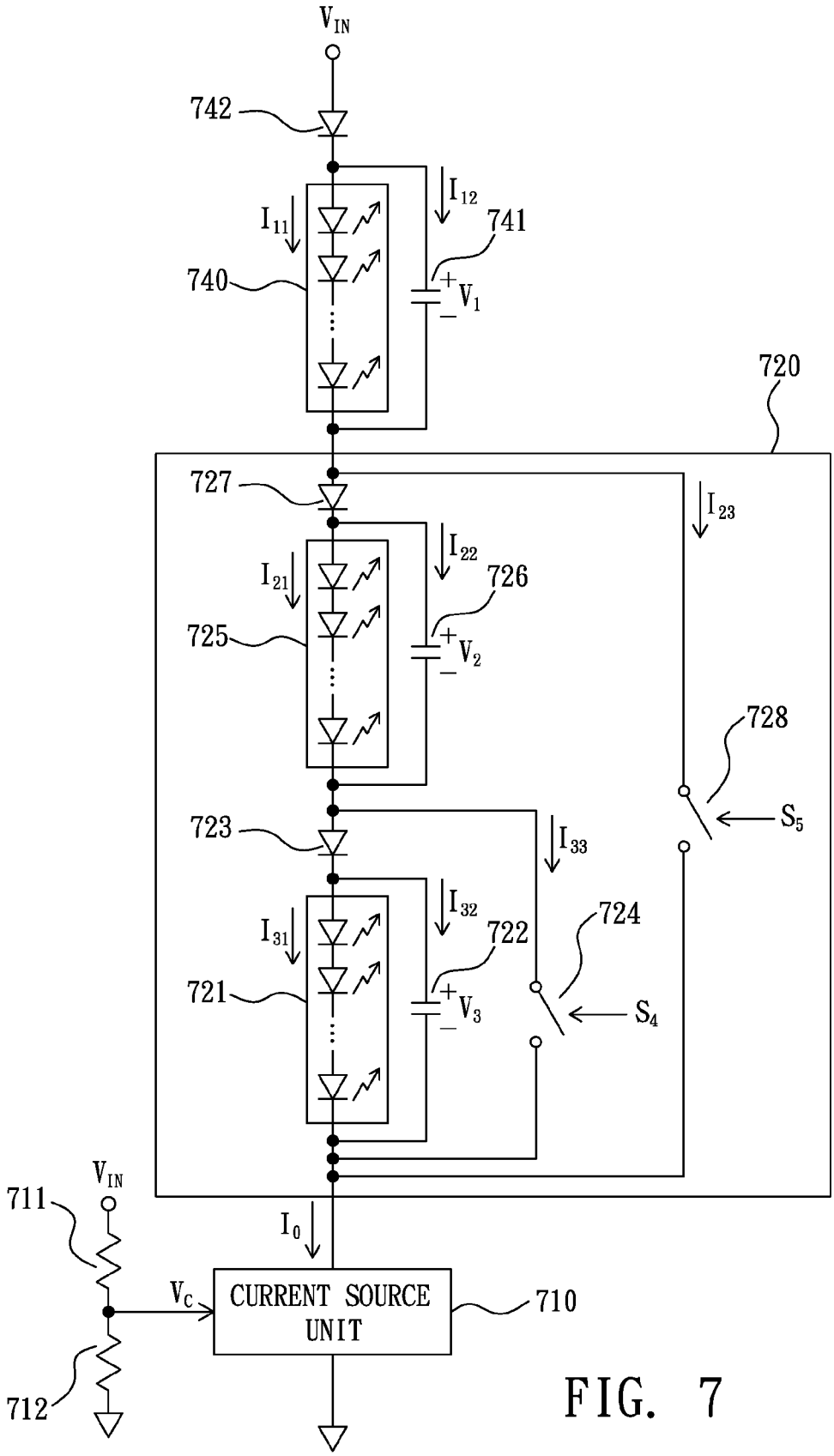
FIG. 7 illustrates a PFC LED driver capable of reducing current ripple according to still another preferred embodiment of the present invention.

Please refer to FIG. 7, which illustrates a PFC LED driver capable of reducing current ripple according to still another preferred embodiment of the present invention. As illustrated in FIG. 7, the PFC LED driver capable of reducing current ripple includes a current source unit 710, resistors 711-712, an LED load unit 720, an LED module 740, a capacitor 741, and a diode 742.

The current source unit 710 has a control terminal coupled to a control voltage $V_C$, a first channel terminal coupled to a ground, and a second channel terminal for generating an output current $I_O$ according to the control voltage $V_C$.

The resistors 711 and 712 are used to divide a full-wave rectified line input voltage $V_{IN}$ to generate the control voltage $V_C$.

The LED load unit 720, being in series with the current source unit 710, includes a first LED module 721, a first capacitor 722, a first diode 723, a first switch 724, a second LED module 725, a second capacitor 726, a second diode 727, and a second switch 728.

The first LED module 721 and the first capacitor 722 are in a first parallel combination to form a first load, and the first LED module 721 has at least one light emitting diode.

The first diode 723 is in a first series combination with the first load.

The first switch 724 is in a second parallel combination with the first series combination.

The second LED module 725 and the second capacitor 726 are in a third parallel combination to form a second load, and the second LED module 725 has at least one light emitting diode.

The second diode 727 is in a second series combination with the second load and the second parallel combination.

The second switch 728 is in a fourth parallel combination with the second series combination.

The LED module 740 and the capacitor 741 are in a parallel combination to form a third load, and the LED module 740 has at least one light emitting diode.

The diode 742 is in series with the third load and is coupled to the full-wave rectified line input voltage V.

When in operation, the output current $I_O$ will follow the control voltage $V_C$, and thereby follow the full-wave rectified line input voltage $V_{IN}$. Besides, switch control signals $S_4$, $S_5$ will switch the switches 724, 728 according to the full-wave rectified line input voltage $V_{IN}$, to select a corresponding LED module or corresponding LED modules from the LED modules 721, 725, and 740 to serve as a load for the LED driver, so as to improve the power efficiency. That is, the LED module 740, for example, will be selected as the load with the switches 724 and 728 being turned on when the full-wave rectified line input voltage $V_{IN}$ is under a first threshold; the LED module 740 and the LED module 725, for example, will be selected to form the load with the switch 724 being turned on and the switch 728 being turned off when the full-wave rectified line input voltage $V_{IN}$ is above the first threshold and under a second threshold; and the LED module 721, the LED module 725, and the LED module 740 will be selected to form the load with the switches 724, 728 being turned off when the full-wave rectified line input voltage $V_{IN}$ is above the second threshold.

As the functions of the diodes 723, 727, 742 and the capacitors 722, 726, 741 are same as those of the counterparts in FIG. 4, they will not be readdressed here.

Figure 8:
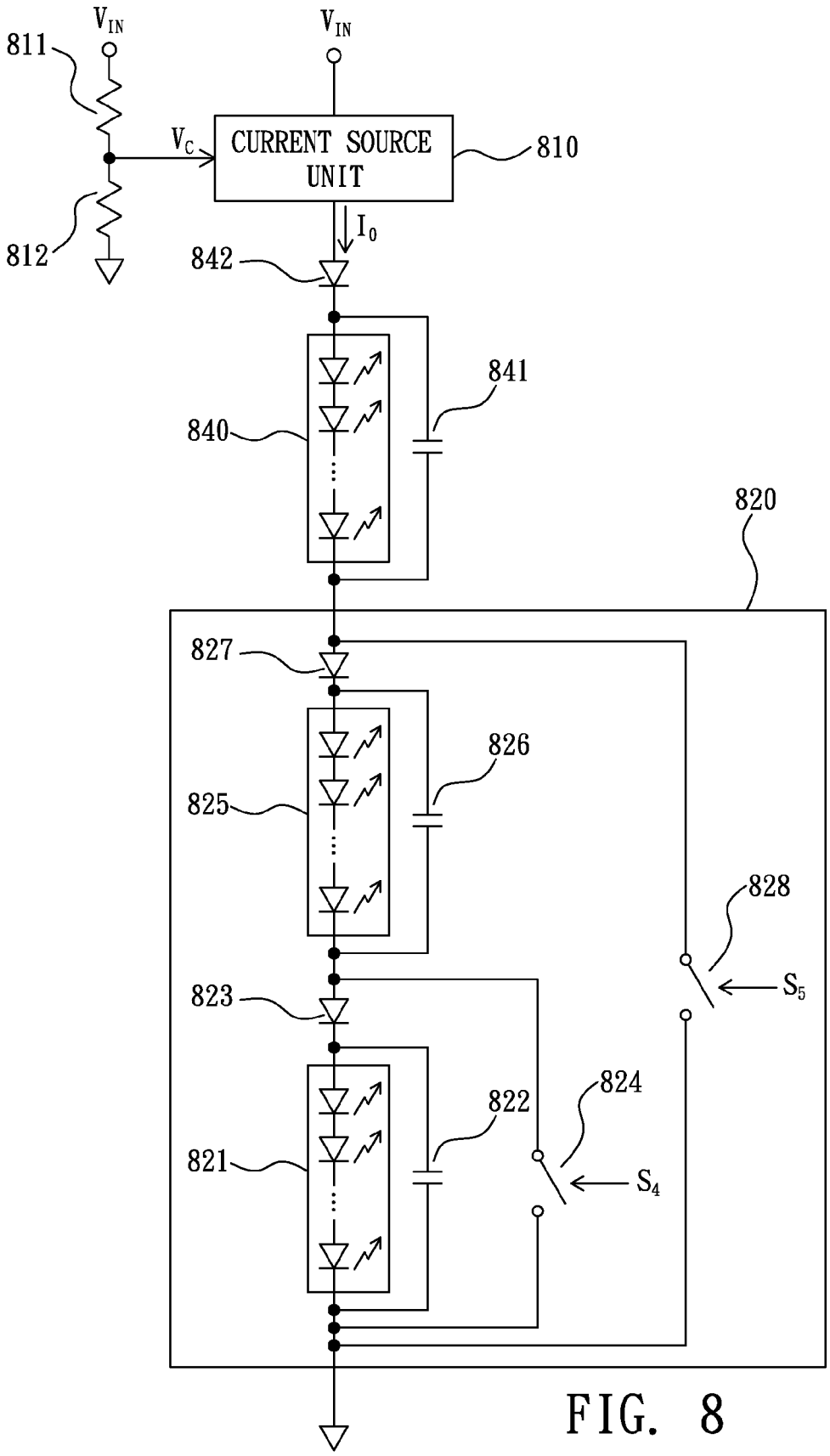
FIG. 8 illustrates a circuit diagram of a PFC LED driver capable of reducing current ripple according to still another preferred embodiment of the present invention.

Although the current source unit 710 is placed at the bottom of the circuit in FIG. 7, it can also be put at the top. Please refer to FIG. 8, which illustrates a circuit diagram of a PFC LED driver capable of reducing current ripple according to still another preferred embodiment of the present invention. As can be seen in FIG. 8, the PFC LED driver capable of reducing current ripple includes a current source unit 810, resistors 811-812, an LED load unit 820, an LED module 840, a capacitor 841, and a diode 842, and the current source unit

810 is at the top of the circuit. As the operational principle of the circuit in FIG. 8 is same as that of the circuit in FIG. 7, it will not be readdressed here.

In conclusion, by virtue of the designs proposed above, the present invention possesses the advantages as follows:

1. The PFC LED driver of the present invention is capable of reducing the current ripple of LEDs to improve the luminous efficiency without compromising the power factor.

2. The PFC LED driver of the present invention is capable of reducing the current ripple of LEDs to improve the luminous efficiency without compromising the electrical power efficiency.

3. The PFC LED driver of the present invention is capable of reducing the current ripple of LEDs to prevent a flicker phenomenon.

While the invention has been described by way of example and in terms of preferred embodiments, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

In summation of the above description, the present invention herein enhances the performance than the conventional structure and further complies with the patent application requirements and is submitted to the Patent and Trademark Office for review and granting of the commensurate patent rights.

What is claimed is:

1. A PFC LED driver capable of reducing current ripple, comprising:

a current source unit, having a control terminal, a first channel terminal, and a second channel terminal, said control terminal being coupled to a control voltage, which is a ratio of a full-wave rectified line input voltage, said first channel terminal being coupled to a power line, and said second channel terminal being used to generate an output current according to said control voltage; and at least one LED load unit, being in series with said current source unit, wherein each of said at least one LED load unit comprises:

a first load, including a first parallel combination of an LED module and a capacitor, wherein said LED module has at least one light emitting diode;

a diode, being in a first series combination with said first load; and a switch, being in a second parallel combination with said first series combination.

2. The PFC LED driver capable of reducing current ripple as disclosed in claim 1, wherein said power line is a ground.

3. The PFC LED driver capable of reducing current ripple as disclosed in claim 1, wherein said power line is said full-wave rectified line input voltage.

4. The PFC LED driver capable of reducing current ripple as claim 1, further comprising a voltage divider, which is coupled between said full-wave rectified line input voltage and a ground for generating said control voltage.

5. The PFC LED driver capable of reducing current ripple as claim 4, wherein said voltage divider comprises two resistors connected in series.

6. A PFC LED driver capable of reducing current ripple, comprising:

a current source unit, having a control terminal, a first channel terminal, and a second channel terminal, said control terminal being coupled to a control voltage, which is a ratio of a full-wave rectified line input voltage, said first channel terminal being coupled to a power line, and said second channel terminal being used to generate an output current according to said control voltage; and an LED load unit, being in series with said current source unit, wherein said LED load unit comprises:

a first load, including a first parallel combination of a first LED module and a first capacitor, wherein said first LED module has at least one light emitting diode;

a first diode, being in a first series combination with said first load;

a first switch, being in a second parallel combination with said first series combination;

a second load, including a third parallel combination of a second LED module and a second capacitor, wherein said LED module has at least one light emitting diode;

a second diode, being in a second series combination with said second load and said second parallel combination; and a second switch, being in a fourth parallel combination with said second series combination.

7. The PFC LED driver capable of reducing current ripple as disclosed in claim 6, wherein said power line is a ground.

8. The PFC LED driver capable of reducing current ripple as disclosed in claim 6, wherein said power line is said full-wave rectified line input voltage.

9. The PFC LED driver capable of reducing current ripple as claim 6, further comprising a voltage divider, which is coupled between said full-wave rectified line input voltage and a ground for generating said control voltage.

10. The PFC LED driver capable of reducing current ripple as claim 9, wherein said voltage divider comprises two resistors connected in series.

* * * * *